US011214407B2

(12) United States Patent
Repp

(10) Patent No.: US 11,214,407 B2
(45) Date of Patent: Jan. 4, 2022

(54) VENTILATABLE VALVE BAG

(71) Applicant: Bischof + Klein SE & Co. KG, Lengerich (DE)

(72) Inventor: Waldemar Repp, Hagen a.T.W. (DE)

(73) Assignee: Bischof + Klein SE & Co. KG, Lengerich (DE)

( * ) Notice: Subject to any disclaimer, the term of this patent is extended or adjusted under 35 U.S.C. 154(b) by 0 days.

(21) Appl. No.: 16/615,154

(22) PCT Filed: May 23, 2018

(86) PCT No.: PCT/EP2018/063557
§ 371 (c)(1),
(2) Date: Nov. 20, 2019

(87) PCT Pub. No.: WO2018/215560
PCT Pub. Date: Nov. 29, 2018

(65) Prior Publication Data

US 2020/0172297 A1 Jun. 4, 2020

(30) Foreign Application Priority Data

May 23, 2017 (DE) ..... 20 2017 103 128.4

(51) Int. Cl.
*B65D 33/01* (2006.01)
*B65D 30/24* (2006.01)
(Continued)

(52) U.S. Cl.
CPC ..... *B65D 33/01* (2013.01); *B65D 31/14* (2013.01); *B31B 70/85* (2017.08); *B31B 2160/20* (2017.08); *B65D 31/08* (2013.01)

(58) Field of Classification Search
CPC ..... B65D 33/01; B65D 31/14; B65D 31/08
(Continued)

(56) References Cited

U.S. PATENT DOCUMENTS 3,117,711 A * 1/1964 Camerini ..... B65D 31/142 383/126
3,628,720 A 12/1971 Schmedding
(Continued)

FOREIGN PATENT DOCUMENTS

AR 032 491 11/2003
DE 1611667 A1 * 5/1971 ..... B65D 33/01
(Continued)

OTHER PUBLICATIONS

Machine translation of EP-2186742-A1.*
Machine translation of ES-2582611-A1.*
Machine translation of ES-1078665-U.*

*Primary Examiner* — Jes F Pascua
(74) *Attorney, Agent, or Firm* — Gudrun E. Huckett

(57) ABSTRACT

The invention relates to a ventilatable valve bag with a wall material (4) comprising at least one gas-permeable inner layer (6) that is impermeable to a filler material and at least one gas-impermeable outer layer (8) as well as two closing sides (10), a first closing side (10) being formed by closing the valve bag (2) and a second closing side (10) being arranged opposite the first closing side (10). An intermediate space (14) is formed between a part of the inner layer (6) defining an inner space (12) of the bag and the outer layer (8), and at least one ventilation channel (18) leading out of a wall material edge section (16) is arranged on at least one closing side (10) of the valve bag (2), between the inner layer (6) and the outer layer (8) of a wall material region, such that the intermediate space (14) can be ventilated to the surroundings.

14 Claims, 3 Drawing Sheets

(51) Int. Cl.
*B31B 160/20* (2017.01)
*B31B 70/85* (2017.01)
*B65D 30/18* (2006.01)

(58) Field of Classification Search
USPC ..... 383/44, 101, 103
See application file for complete search history.

(56) References Cited

U.S. PATENT DOCUMENTS

| | | | | |
|---|---|---|---|---|
| 3,989,182 | A | 11/1976 | Stearley | |
| 6,883,964 | B2 * | 4/2005 | Beaulieu | B65D 31/02 383/101 |
| 2016/0332781 | A1 | 11/2016 | Lisek et al. | |
| 2017/0253382 | A1 | 9/2017 | Zum-Dohme et al. | |
| 2019/0217994 | A1 * | 7/2019 | Duruduygu | B65D 31/145 |

FOREIGN PATENT DOCUMENTS

| | | | | |
|---|---|---|---|---|
| DE | 21 32 668 | | 1/1973 | |
| DE | 3202032 | A1 * | 8/1983 | B65D 31/04 |
| DE | 20 2014 000 194 | | 5/2015 | |
| DE | 20 2014 007 340 | | 1/2016 | |
| DE | 202017001357 | U1 * | 6/2018 | B65D 33/01 |
| EP | 0 126 816 | | 12/1984 | |
| EP | 2 186 741 | | 5/2010 | |
| EP | 2186742 | A1 * | 5/2010 | B65D 33/01 |
| EP | 2955126 | A2 * | 12/2015 | B65D 33/01 |
| EP | 3184297 | A1 * | 6/2017 | D21H 27/10 |
| ES | 1078665 | U * | 2/2013 | |
| ES | 2582611 | A1 * | 9/2016 | |
| FI | 102 526 | | 12/1998 | |
| WO | WO-9746460 | A1 * | 12/1997 | B65D 33/01 |
| WO | 99/01353 | | 1/1999 | |

* cited by examiner

VENTILATABLE VALVE BAG

BACKGROUND OF THE INVENTION

The invention concerns a ventilatable valve bag with a wall material that comprises at least one inner layer permeable to gas and impermeable to fill material as well as at least one outer layer impermeable to gas. The valve bag comprises two closure sides wherein a first closure side is embodied by closing the bag and a second closure side is arranged facing away from the first closure side. An intermediate space is formed between a part of the inner layer which delimits a bag interior and the outer layer.

Such a valve bag is known, for example, from EP 2 186 741 B1. It is used primarily for storage and for transport of powder-like or granular or free flowing or pourable fill materials such as cement or animal feed. In order for the air introduced into the bag interior upon filling of the valve bag to subsequently escape from it, the valve bag is ventilatable. In the prior art, the valve bag comprises a venting opening in the region of a longitudinal edge, to which a main surface of the valve bag extends and which is embodied as a fold edge, together with an interrupted longitudinal sealing seam. In this embodiment of the valve bag, its structure is weakened in a highly stressed region by the venting opening and the required interrupted longitudinal sealing seam, wherein folding of the wall material by 180° leads to a considerable stretching or compression of the wall material layers. Moreover, the venting effect is limited in that upon storage of the valve bag, where a plurality of valve bags are in general resting on each other with their main sides, an outflow opening for the air is blocked by the weight force of possibly stacked-on valve bags. A high resistance for venting is provided additionally due to multiple deflections of the air flow between intermediate space and environment.

Object of the present invention is to increase the stability of a ventilatable valve bag and to configure the venting action as reliable as possible in this context.

SUMMARY OF THE INVENTION

According to the invention, the object is solved in that, on at least one closure side of the valve bag between the inner layer and the outer layer of a wall material region, a venting channel is arranged. The latter opens in such a way out of a wall material rim section such that through it the intermediate space is configured to be ventilatable to the environment.

Through the venting channel, the air which has passed from the bag interior through the inner layer into the intermediate space is discharged at the closure side. The bag interior is the space which is located within the closed valve bag and is delimited by the wall material. In it, the free flowing or pourable fill material is arranged after filling of the valve bag. A closure side in this context is the side of the valve bag by whose formation the bag is closed wherein a second closure side is arranged parallel to the first mentioned one at the oppositely positioned or opposed end of the valve bag after closure of the valve bag. The venting channel is arranged within a region of the same multi-layer wall material between its inner and outer layers and is thus not positioned between an outer layer of a first wall material section and the inner layer of a further wall material section folded against it.

The inner layer and the outer layer of the wall material arranged at the closure side are not connected in a region which extends from a wall material rim to the rim of the closure side. The wall material has a substantially areal extension wherein its thickness is multiple times smaller than the length of its continuous wall material rim at the closure side. Typically, the wall material is formed of a multi-layer plastic film. The wall material rim describes a surface area of the wall material whose width, regardless of the venting channel, corresponds to the thickness of the wall material and which delimits an inner and an outer main surface of the wall material. The wall material rim section is a continuous part of the wall material rim wherein the width of the wall material rim section is identical to that of the wall material rim.

Since the valve bag according to the invention comprises the at least one venting channel at the closure side, the stability of the valve bag is improved. The closure sides are the sides of a valve bag which are stressed the least and a discharge of air at this side effects a greatest possible stability. During filling as well as during storage, possible critical loads are acting on the wall material which in general forms the larger main and/or lateral sides of the valve bag. By the arrangement of the venting channel a particularly reliable venting action of the valve bag is also possible in that the valve bag can vent even when it is filled and closed and is stored by stacking. Due to the configuration of the venting channel according to the invention, the valve bag can continue to vent even during such storage.

Preferably, at least one closure side is configured by folding the wall material. This concerns in this context the closure side on which the venting channel is arranged. Folding of the wall material for closure of the valve bag leads to an increased stability and reliability of the valve bag at the closure side. The structural weakening of the wall material due to the venting channel is compensated by folding.

Preferably, the same closure side is configured by folding of the wall material like a cross bottom. A cross bottom is characterized in that, beginning with an open valve bag, first two oppositely positioned corner flaps are folded in the direction toward the interior of the bag. These corner flaps have no contact with each other. Subsequently, lateral flaps are formed from wall material regions adjoining the main surfaces of the valve bag, in that these wall material regions are also folded. As a result, parts of the lateral flaps are resting on each other and on the corner flaps positioned underneath so that, after appropriate fixation, the valve bag is reliably closed.

The cross bottom increases the stability of the valve bag in the region of the venting channel. In this way, an accidental closure of the venting channel, caused by a stress buildup in the wall material at the closure side, is prevented, whereby the valve bag as such as well as its venting action are particularly reliable. A further advantage of this preferred configuration is the possibility of a simple air guiding action between intermediate space and environment because the sections of the wall material forming the closure side are folded only by 90°, respectively, relative to the wall material sections that form the main and lateral sides of the valve bag. At this fold edge, the air flow is deflected only once which reduces its resistance and makes the venting action more reliable. Alternatively or in addition, the venting channel is delimited by an inner layer which is arranged at the closure side as well as delimits the bag interior so that the interior can vent directly into a venting channel at the bottom side, for example.

Particularly preferred, the venting channel is embodied in an outer lateral flap which partially forms the closure side. The outer lateral flap is that one of the two lateral flaps that, relative to the bag interior, adjoins the inner lateral flap. It is referred to as outer, notwithstanding a cover sheet that is possibly fixed to the closure side. Since the venting channel extends in the wall material that forms the outer lateral flap, the air is guided from of the intermediate space particularly easily into the environment because the venting channel cannot be closed due to possible stress in an overlaid wall material layer.

In an advantageous embodiment of the invention, the outer lateral flap comprises the wall material rim section in such a way that the latter adjoins the environment. Since the wall material rim section with the outflow opening is positioned outwardly, the air is immediately in the environment after outflow from the venting channel. This enables, in turn, a conventional and particularly stable fixation of the closure side in which the lateral flaps are glued areally with their bottom sides facing the bag interior to the corner flaps or the inner lateral flap. Also, it minimizes the resistance for the air flow in that the air flow is not guided with resistance through a further limited cross section. When the outer lateral flap is glued only along an adhesive strip which extends along the lateral flap rim adjoining the environment, the venting channel extends across a length that corresponds to the width of the wall material rim strip or the adhesive strip. In case that, beginning at the wall material rim strip, possible covers of the lateral flap are present, the venting channel is extended correspondingly.

The valve bag can be produced by folding of a hose-shaped wall material at the closure side which is fixed by a longitudinal seam that connects two sides of the wall material. This longitudinal seam extends from one wall material rim at the closure side to the other wall material rim at the closure side and extends, for reasons of stability, preferably across one of the main surfaces of the valve bag. Due to the better print image, the main surface of the bag which is facing away from the longitudinal seam is provided with a front print that is not impaired by a seam and is visible from above for conventional storage and transport of the bag. In order to prevent in this context a gravity-induced penetration of foreign matter, in particular water, into the venting channel, the cross bottom is preferably embodied such that the longitudinal seam extends across the inner lateral flap of the at least one closure side. In this way, it is ensured that, for conventional flat storage, the lateral flap comprising the venting channel is folded, beginning at the horizontal front main surface, in downward direction toward the rear main surface with the longitudinal seam. The opening of the venting channel is downwardly oriented so that penetration of water by capillary action is also made difficult or prevented by the oppositely acting force of gravity.

Preferably, a central longitudinal axis of the venting channel extends substantially parallel to a narrow edge of the at least one closure side. The closure side is delimited by two oppositely positioned narrow edges and two wide edges adjoining them. The narrow edges are positioned between the closure side and a lateral side and are positioned on the lines at which the corner flaps of the closure side adjoin a lateral side. The wide edge, on the other hand, delimits the closure side relative to a main side of the valve bag.

In a preferred embodiment, the central longitudinal axis of the venting channel has at each location within the venting channel the same spacing to two venting channel boundary lines which delimit the venting channel transverse to the direction of the air flow at both sides thereof. In this context, the venting channel can also be delimited by the parts of the outer lateral flap which do not adjoin the environment and by means of which the lateral flap is contacting the corner flaps. The central longitudinal axis of the venting channel intersects the one of the wide edge, to which the venting channel extends at the closure side, between two auxiliary points which are arranged on the wide edge and are displaced by an imaginary displacement of the two boundary points of the wall material rim section in a direction parallel to the narrow edge. The boundary points form the point of intersection of wall material rim and venting boundary lines. The central longitudinal axis does not necessarily intersect the wall material rim section.

Due to this course of the venting channel, a path as short as possible for the air flow from the intermediate space to the wall material rim section is ensured. In this way, venting of the valve bag can be realized particularly reliably.

Preferably, the inner layer and the outer layer are connected to each other at the closure side along a wall material rim strip which adjoins the wall material rim. In this context, the inner layer and the outer layer are not connected solely in a portion of the wall material rim strip which adjoins immediately the wall material rim section. The wall material rim strip is a section of the wall material which adjoins the complete wall material rim at the closure side and, in this context, has a preferably constant extension in a direction facing away from the wall material rim. The outflow opening of the venting channel is positioned between inner layer and outer layer in the wall material rim section. This outflow opening and the adjoining outermost part of the venting channel are delimited laterally, i.e., at the venting channel boundary lines, by the connection of inner layer and outer layer in the wall material rim strip.

In this context, this substantial connection of inner and outer layers in the wall material rim strip is preferably produced prior to folding of the closure side. In this context, the inner layer and the outer layer are connected to each other across a predominant portion of the circumference along the wall material circumference of the open bag. The connection can be in the form of a plurality of connecting points spaced apart from each other or in the form of a continuous connecting strip. Only the part of the wall material rim strip through which the venting channel is extending remains completely unconnected. By connecting the inner layer and the outer layer to the described extent, the stability of the valve bag at the closure side can be further increased. In particular, in this way a relative movement between inner layer and outer layer is prevented and thereby the shape stability of the closure side is ensured. At the same time, the venting channel is formed in a simple way.

Particularly preferred, the inner layer and the outer layer are produced of the same material. Since the materials of inner layer and outer layer are identical, it is possible to select for both layers the material which provides the optimal properties in regard to the stability of the valve bag. The risk of interactions between different materials and particular requirements in regard to connecting inner layer and outer layer of different materials can thus be precluded. As a whole, the stability of the valve bag can be increased again in this way. In an advantageous embodiment of the invention, the inner layer and the outer layer are predominantly, i.e., to more than 50%, embodied of polyolefin, in particular of polyethylene. This material is characterized by a particularly high stretchability and impact resistance. These properties make the valve bag particularly load resistant relative to environmental influences.

Preferably, the part of the inner layer that is delimiting the bag interior has venting openings. These venting openings serve for guiding the air out of the interior of the bag into the intermediate space. The outer layer of the wall material remains without openings. The venting openings whose cross section is smaller than the smallest cross section of the fill material particles serve for discharge of air out of the bag interior as efficiently as possible. Due to the number and size of the venting openings that can be varied within a wide range, a high total venting surface area, combined of the cross sections of the existing venting openings, on the main and lateral surfaces of the valve bag and a good adaptation to various film materials can be realized. The venting openings enable thus an increase of the reliability of the venting action for different fill materials.

Preferably, the valve bag comprises spacer elements that define the intermediate space. These spacer elements ensure that the intermediate space has a minimum volume even when venting does not occur and that the outer layer does not contact a predominant portion on the inner layer provided with openings. This facilitates, for example, in case of restart of venting during storage, the discharge of the air out of the bag interior in that the outer layer cannot lay flat on the inner layer prior thereto and a required spacing of the wall material layers and the transfer of air into the intermediate space between the inner and outer layers are thus facilitated.

Particularly preferred, the spacer elements are formed by rims of the venting openings in the inner layer. By stamping or the like, venting openings can be formed in the inner layer whose rim is embodied in the direction of the outer layer and displaced transverse to the areal extension of the inner layer. When the inner and outer layers are in a stretched state, the outer layer has only contact to these facing rim regions of the inner layer. The reliability of the venting action is increased by such spacer elements embodied in this way in that they particularly reliably realize the valve action of the venting action. When in the bag interior a pressure increased in comparison to the environment exists, the outer layer can be lifted against only minimal resistance and the air from the bag interior can reach the environment through the venting channel. When, on the other hand, the pressure in the bag interior is lower than in the environment, the outer layer adjoining the intermediate space rests on the rim regions of the inner layer, wherein the contact pressure of the layers on each other is increased due to the reduced contact surface of the two and prevents an inflow of air into the bag interior.

In an advantageous embodiment of the invention, a cover sheet which covers the wall material rim section is arranged at the at least one closure side. This cover sheet that is glued on across the surface forms partially the venting channel. By the fixation of such a cover sheet at the closure side, the shape stability of this side is increased. The wall material rim section can be arranged at a wide edge of the closure side as well as between the two wide edges. When the wall material rim section is arranged between the two wide edges, the venting channel is extended from the wall material rim section to a rim of the closure side/cover sheet contact surface by a contacting cover sheet.

Preferably, between the at least one closure side and the cover sheet, a cover element is arranged which extends from the wall material rim section to a rim of the cover sheet. The closure side and the cover sheet are conventionally connected to each by an adhesive agent applied across the entire surface area at their contact surface. The cover element without adhesive agent enables the extension of the venting channel such that by resting on the adhesive agent, it prevents between it and the wall material or between it and the cover sheet bonding of wall material and cover sheet in sections. It forms between wall material rim section and the rim of the cover sheet an unglued hollow space in such a way that, in case of a sufficient pressure differential between intermediate space and environment, a venting action is realized through this hollow space as well as the remainder of the venting channel. In this way, an air permeable connection between cover sheet and closure side is ensured that adjoins the wall material rim section. While maintaining the reliability of the venting action, the utilization of the cover element enables in this context the use of conventional methods for gluing together cover sheet and closure side. They, in turn, provide reliably a stabilization of the valve bag at the closure side.

The venting channel in this embodiment as well as in the other embodiments of the invention must not be continuously embodied, which prevents the penetration of insects, moisture or other foreign materials. Without sufficient excess pressure, top side and bottom side of the venting channel can be resting on each other.

As an alternative to the cover element, the closure side/cover sheet contact surface can be provided with a surface area without adhesive where the cover sheet and the closure side are not glued together for extending the venting channel.

BRIEF DESCRIPTION OF THE DRAWINGS

Further details and advantages of the invention can be taken from the embodiments described in following and schematically illustrated; it is shown in.

DESCRIPTION OF PREFERRED EMBODIMENTS

Figure 1:
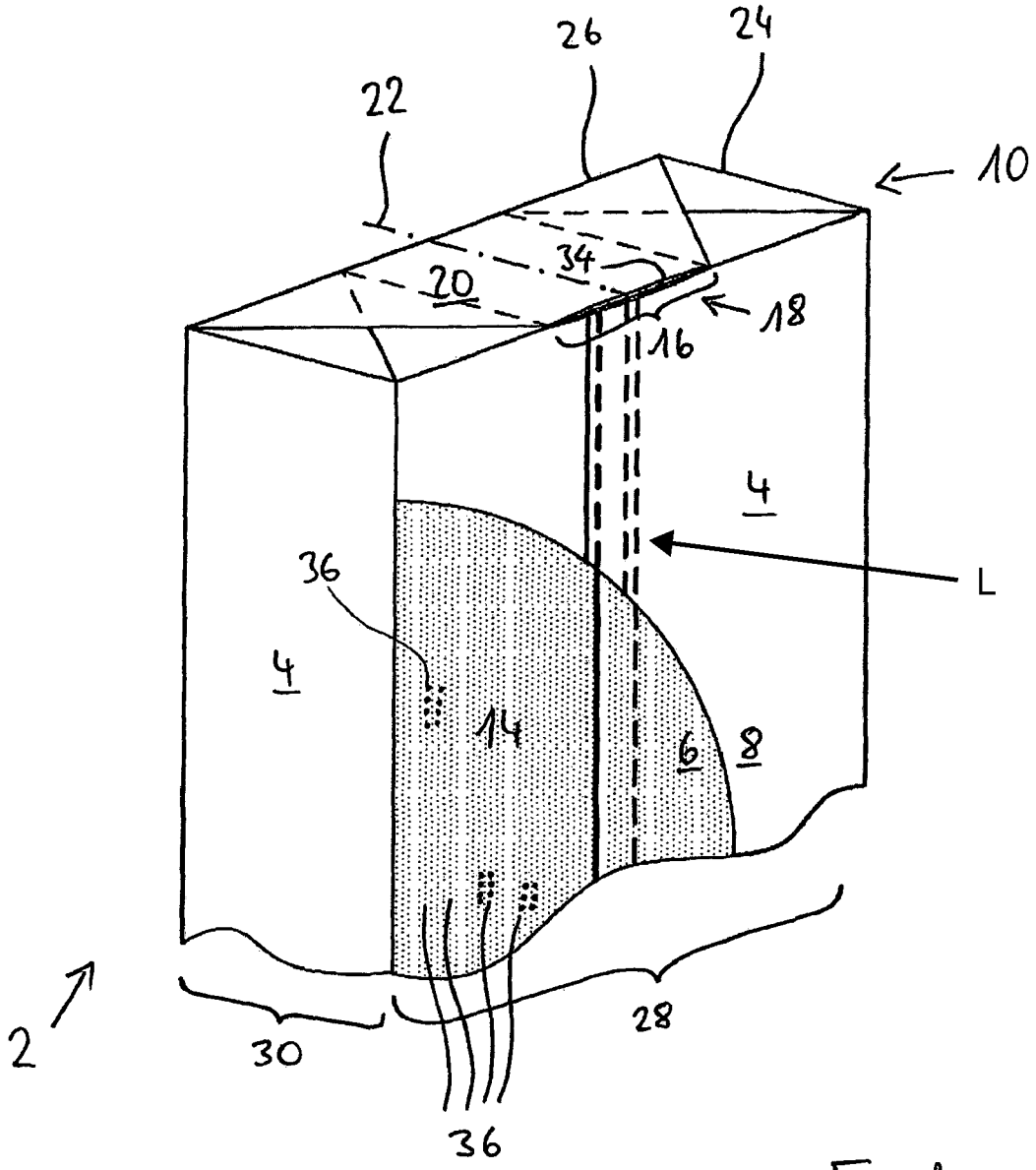
FIG. 1 a perspective illustration of a part of an embodiment of a valve bag according to the invention.

The features of the embodiments according to the invention explained in the following can also be subject matter of the invention individually or in other combinations than illustrated or described, however always at least in combination with the features of the independent claim. Functionally same acting parts are provided with identical reference characters, if expedient.

FIG. 1 shows a closure side 10, a lateral side 30 as well as a main side 28 of a ventilatable valve bag 2 in a perspective illustration, wherein a longitudinal seam L connects two sides of a wall material 4 to a hose shape. The illustration of the valve bag 2 is sectioned in the lower region. A wall material 4 of which the valve bag 2 is substantially embodied comprises an outer layer 8 visible from the exterior and an inner layer 6 at the inner side that is contacting and/or adjoining the outer layer 8 and in FIG. 1 is made visible by a partially sectioned view of the main side 28.

Figure 3:
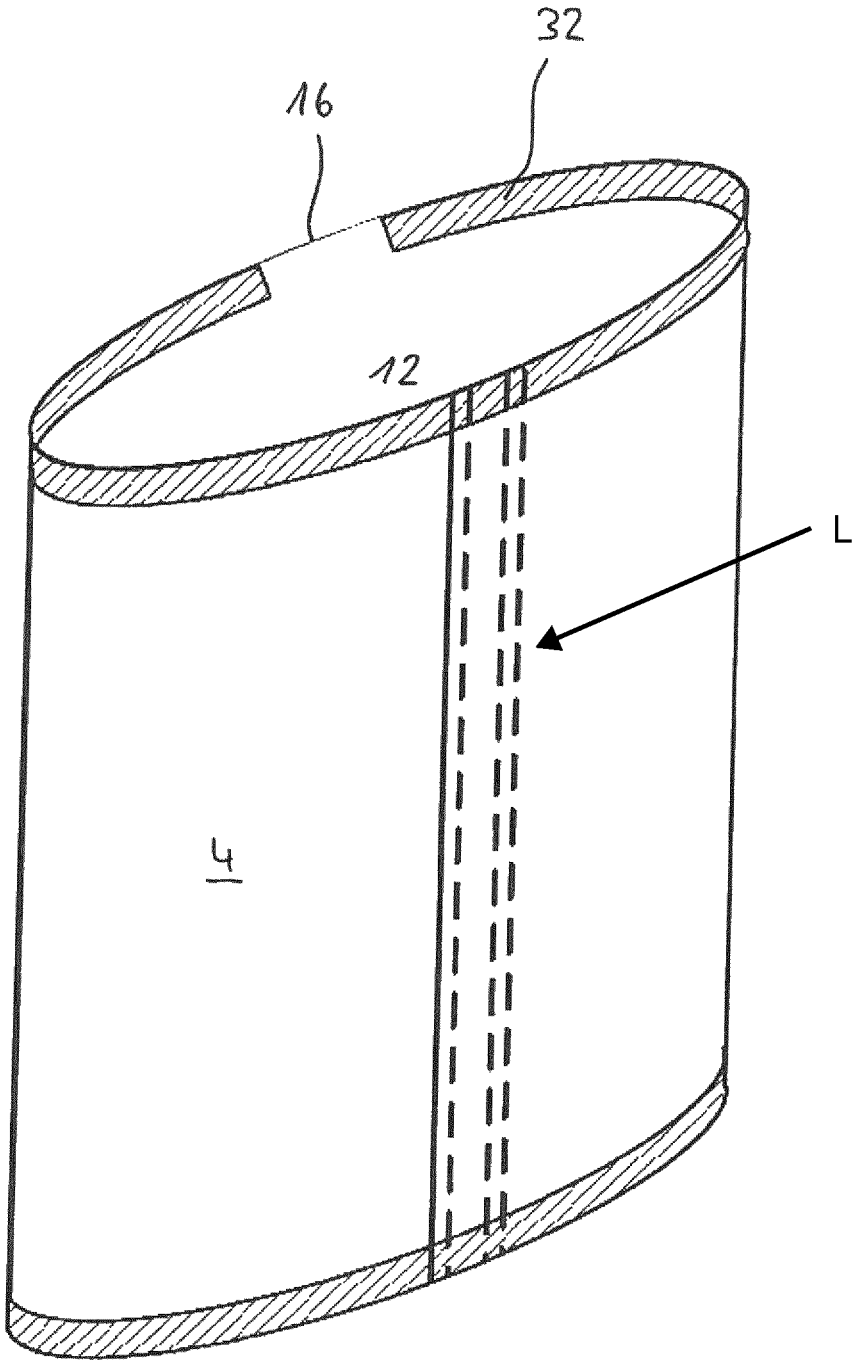
FIG. 3 a perspective illustration of a wall material blank for producing the embodiment of the valve bag of FIG. 1 in accordance with the invention.

FIG. 3 is a perspective illustration of a valve bag blank that is not yet closed. It is comprised of a hose-shaped wall material 4 with longitudinal seam L connecting two sides of the wall material 4. By closing the valve bag blank or the valve bag 2 formed thereof, a bag interior 12 is defined which is indicated in FIG. 3 as a result of the open state of the valve bag blank. Between a part of the inner layer 6 which delimits the bag interior 12 and the outer layer 8, there is an intermediate space 14. In the illustrated embodiment according to FIG. 1, the latter is at the main surface between the inner layer 6 and the outer layer 8. The inner layer 6 is in this context permeable to gas and impermeable to the fill material which is to be filled into the bag interior 12. This is achieved by a plurality of venting openings 36 (compare FIG. 1) which are identified by dots which are provided in the inner layer 6 and which are partially shown enlarged. The outer layer 8 which delimits the intermediate space 14 at the side facing the environment is in this context impermeable to gas as well as to the fill material. The intermediate space 14 can extend completely or partially across two main sides 28 and two lateral sides 30.

At the closure side 10 illustrated in FIG. 1, the ventilatable valve bag 2 has an outflow opening 34 into which a venting channel 18 opens. This venting channel 18 connects the intermediate space 14 and the environment so that air from the intermediate space 14 can flow through the venting channel 18 to the environment. The outflow opening 34 is positioned in this context in a wall material rim section 16 in which the inner layer 6 and the outer layer 8 of a wall material region are spaced apart from each other.

The closure side 10 of the ventilatable valve bag 2 is embodied by folding the wall material 4 to a cross bottom. This cross bottom has a lateral flap that is inwardly positioned and therefore only visible to a smaller extent at a real valve bag and an outer lateral flap 20. The wall material rim section 16 in which the outflow opening is positioned is part of this outer lateral flap 20. Moreover, the wall material rim section, regardless of the cover sheet or the like which is possibly applied to the closure side 10, adjoins immediately the environment.

The venting channel 18 extends from the wall material rim section 16 substantially in the direction of its central longitudinal axis 22 to a wide edge 26 of the closure side 10 where the wall material 4 is folded and where the outer lateral flap 20 adjoins a main side 28. The central longitudinal axis 22 of the venting channel 18, which at any location along the closure side 10 has a substantially identical spacing to the two transversely and parallel extending venting channel transverse boundaries, extends in this context parallel to the two narrow edges 24 of the closure side 10 (compare FIG. 1).

FIG. 3 shows that the inner layer 6 and the outer layer 8 are connected to each other at the closure side along a wall material rim strip 32 which adjoins the wall material rim and has a constant width along the circumference of the valve bag blank. This connection of the inner layer 6 and of the outer layer 8 at the closure side is interrupted in the section of the wall material rim strip 32 which adjoins the wall material rim section 16 in order to form the outflow opening 34 where the inner layer 6 and the outer layer 8 are spaced apart from each other.

Figure 2:
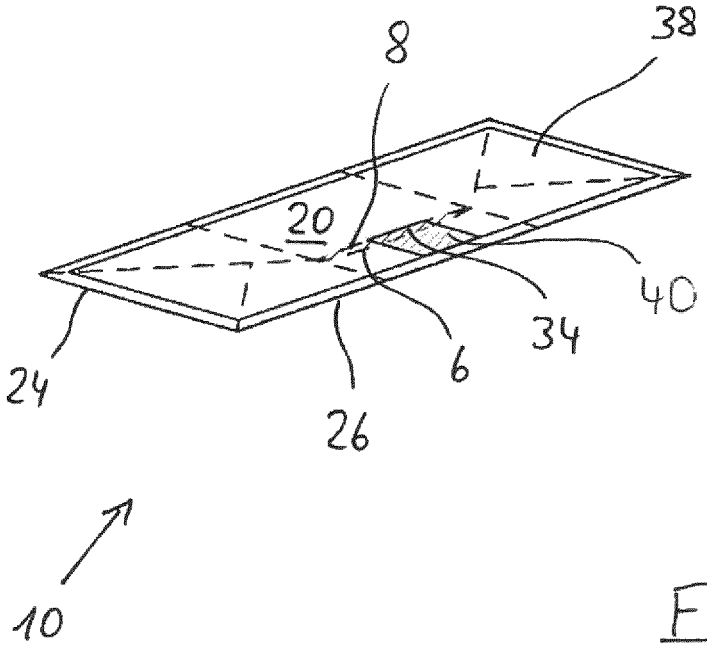
FIG. 2 a perspective illustration of a closure side of a further embodiment of a valve bag according to the invention.

FIG. 2 shows a closure side 10 of a different embodiment of the valve bag according to the invention. A transparent cover sheet 38 whose lateral rim is substantially corresponding to the narrow edges 24 and the wide edges 26 of the closure side 10 is applied onto the illustrated closure side 10. The cover sheet 38 is glued to the closure side 10.

The outer lateral flap 20 does not extend from a wide edge 26 to the oppositely positioned one so that the outflow opening 34 is located between both wide edges 26 at the closure side 10. Because the applied cover sheet 38 is glued to the closure side 10, the venting channel 18 is embodied from the outflow opening 34 to the closer wide edge 26 by the cover sheet. In this region, the venting channel 18 extends between the cover sheet 38 and the inner lateral flap outside of the wall material 4. It is formed by a cover element 40 in the region marked correspondingly by dashed lines.

LIST OF REFERENCE CHARACTERS

2 valve bag
4 wall material
6 inner layer
8 outer layer
10 closure side
12 bag interior
14 intermediate space
16 wall material rim section
18 venting channel
20 outer lateral flap
22 central longitudinal axis
24 narrow edge
26 wide edge
28 main side
30 lateral side
32 wall material rim strip
34 outflow opening
36 venting opening
38 cover sheet
40 cover element

What is claimed is:

1. A ventilatable valve bag comprising:

a wall material fixed by a longitudinal seam connecting two sides of the wall material to form a circumferentially closed hose, the wall material consisting of an inner plastic film layer, permeable to gas and impermeable to a fill material, and of an outermost plastic film layer impermeable to gas and exposed to an environment of the ventilatable bag, wherein a part of the inner plastic film layer delimits circumferentially all around a bag interior of the ventilatable valve bag;

a first closure side and a second closure side, wherein the first closure side is formed by closing the ventilatable valve bag and the second closure side is arranged facing away from the first closure side;

an intermediate space formed between the part of the inner plastic film layer delimiting circumferentially all around the bag interior of the ventilatable valve bag and the outermost plastic film layer, wherein the intermediate space extends circumferentially from one side of the longitudinal seam to the other side of the longitudinal seam around the bag interior, and wherein the part of the inner plastic film layer delimiting circumferentially all around the bag interior comprises venting openings permitting gas to pass from the bag interior into the intermediate space;

at least one venting channel arranged on the first closure side and/or the second closure side between the inner plastic film layer and the outermost plastic film layer of a wall material region of the wall material, wherein the at least one venting channel opens at a wall material rim section of the wall material and is configured to ventilate the intermediate space toward the environment of the ventilatable valve bag;

wherein the at least one venting channel is embodied in an outer lateral flap forming a part of the first closure side or of the second closure side.

2. The ventilatable valve bag according to claim 1, wherein the first closure side and/or the second closure side is embodied by folding the wall material.

3. The ventilatable valve bag according to claim 2, wherein the first closure side and/or the second closure side is a cross bottom.

4. The ventilatable valve bag according to claim 1, wherein the outer lateral flap is a part of a cross bottom that forms the first closure side or the second closure side.

5. The ventilatable valve bag according to claim 4, wherein the outer lateral flap comprises the wall material rim section and the wall material rim section adjoins the environment.

6. The ventilatable valve bag according to claim 1, wherein a central longitudinal axis of the at least one venting channel extends substantially parallel to a narrow edge of the first closure side or the second closure side.

7. The ventilatable valve bag according to claim 1, wherein the inner plastic film layer and the outermost plastic film layer are formed of the same material.

8. The ventilatable valve bag according to claim 7, wherein the inner plastic film layer and the outermost plastic film layer are formed primarily of a polyolefin.

9. The ventilatable valve bag according to claim 8, wherein the polyolefin is polyethylene.

10. The ventilatable valve bag according to claim 1, further comprising spacer elements that define the intermediate space by spacing apart the outermost plastic film layer and the part of the inner plastic film layer delimiting the bag interior of the ventilatable valve bag.

11. The ventilatable valve bag according to claim 10, wherein the spacer elements are formed by rims of the venting openings.

12. The ventilatable valve bag according to claim 1, further comprising spacer elements that define the intermediate space by spacing apart the outermost plastic film layer and the part of the inner plastic film layer delimiting the bag interior of the ventilatable valve bag.

13. The ventilatable valve bag according to claim 1, further comprising a cover sheet arranged on the first closure side or the second closure side, wherein the cover sheet covers the wall material rim section and forms partially the at least one venting channel.

14. The ventilatable valve bag according to claim 13, further comprising a cover element arranged between the first closure side or the second closure side and the cover sheet, wherein the cover element extends from the wall material rim section to a rim of the cover sheet.

* * * * *